United States Patent [19]

Drabowitch

[11] Patent Number: 4,513,291

[45] Date of Patent: Apr. 23, 1985

[54] WAVEGUIDE HAVING RADIATING SLOTS AND A WIDE FREQUENCY BAND

[75] Inventor: Serge Drabowitch, Paris, France

[73] Assignee: Thomson-CSF, France

[21] Appl. No.: 412,210

[22] Filed: Aug. 27, 1982

[30] Foreign Application Priority Data

Sep. 11, 1981 [FR] France ..... 81 17236

[51] Int. Cl.[3] ..... H01Q 13/10

[52] U.S. Cl. ..... 343/771

[58] Field of Search ..... 343/768, 770, 771

[56] References Cited

U.S. PATENT DOCUMENTS

| | | | |
|---|---|---|---|
| 3,183,511 | 5/1965 | Ajioka | 343/771 |
| 3,189,908 | 6/1965 | Provencher | 343/771 |
| 3,530,479 | 9/1970 | Waldron | 343/771 |
| 3,696,433 | 10/1972 | Killion et al. | 343/771 |
| 3,936,836 | 2/1976 | Wheeler et al. | 343/771 |

FOREIGN PATENT DOCUMENTS

| | | |
|---|---|---|
| 917319 | 8/1954 | Fed. Rep. of Germany . |
| 1134384 | 4/1957 | France . |
| 2077327 | 10/1971 | France . |
| 2189890 | 1/1974 | France . |
| 592760 | 9/1947 | United Kingdom . |

OTHER PUBLICATIONS

Mikoshiba et al., Radiation from a Coaxial Cable; Elec. & Comm. in Japan; vol. 51-B, Nov. 10, 1968, pp. 61-67.

*Primary Examiner*—Eli Lieberman

*Attorney, Agent, or Firm*—Cushman, Darby & Cushman

[57] ABSTRACT

Each radiating slot having a length L in the vicinity of the operating wavelength λ of a direct-radiation slotted rectangular waveguide is placed on one side of the waveguide so as to be parallel to the lines of current flow and is provided with a transverse stepped section formed at the center of the slot at right angles to the current lines.

6 Claims, 6 Drawing Figures

WAVEGUIDE HAVING RADIATING SLOTS AND A WIDE FREQUENCY BAND

BACKGROUND AND SUMMARY OF THE PRESENT INVENTION

This invention relates to a direct-radiation slotted rectangular waveguide having a wide frequency band.

In the field of radar antennas, a particularly simple and compact antenna consists of a rectangular waveguide having radiating slots excited by traveling waves, the operation of which will now be recalled.

In the first place, a slot radiates power when it intersects current lines. Since it can in fact be compared with an impedance Z placed in series on the current lines, a potential difference appears between the walls of the slot and this consequently produces radiation to the exterior.

In accordance with Babinet's principle, it is deduced in the second place that the field radiated by a slot has the same nature at that which is radiated by a dipole having the same width, their respective polarizations being perpendicular.

Furthermore, since the power radiated by the slot is proportional to the square of the current which flows through said slot, coupling of the slot with the waveguide can accordingly be adjusted by choosing its position and its angle of inclination.

In accordance with conventional practice and as shown in FIG. 1*a*, the slots 1 can be placed longitudinally along the broad side 2 of the waveguide 3 and displaced off-center to a greater or lesser extent or else placed transversely on the narrow side 4 of the waveguide in more or less inclined positions as shown in FIG. 1*b*. Although they offer the advantage of radiating practically the entire waveguide power, said slots suffer from a disadvantage in that they have conductances which vary rapidly as a function of the frequency, thereby producing a variation in coupling of the slots with the waveguide and instability of the law of illumination which governs the radiation pattern and particularly the sidelobes.

A complex solution has been found in answer to this problem by exciting each radiating slot of the waveguide by means of a directional coupler extending within the guide but the construction involved is complex.

The object of the present invention is to provide a direct-radiation slotted rectangular waveguide which offers the further advantage of operating over a wide frequency band.

The direct-radiation slotted rectangular waveguide according to the invention is such that each radiating slot having a length L in the vicinity of the operating wavelength (λ) of the waveguide is placed on one side of the waveguide so as to be parallel to the lines of current flow along said side and is provided with a transverse stepped section formed in its central portion at right angles to the current lines.

According to one distinctive feature of the invention, the slots are formed on either a broad or a narrow side of the waveguide.

Other features of the invention will be more apparent upon consideration of the following description, reference being made to FIGS. 2 to 5 of the accompanying drawings which, apart from FIG. 1 which relates to the prior art, illustrate examples of construction of a radiating-slot waveguide according to the invention.

BRIEF DESCRIPTION OF THE ACCOMPANYING DRAWINGS

FIGS. 1(*a*) and 1(*b*) each depict conventional slotted waveguides;

FIG. 2 is a cross-sectional elevational view of a slotted waveguide of the present invention; and FIGS. 3–5 each show other embodiments of the slotted waveguide of the present invention.

DETAILED DESCRIPTION OF THE PREFERRED EMBODIMENTS

As stated earlier in connection with a slotted waveguide of the prior art, the disadvantage of these slots lies in the fact that they have a conductance which varies rapidly as a function of the frequency and therefore prevent operation of the waveguide over a wide frequency band. For this reason, a radiating antenna constructed by making use of novel radiating elements and especially slots according to the invention must be such that each element must have a radiation admittance and in particular a conductance which is in the active portion and is stable as a function of the frequency. In addition, it must be ensured that the excitation element of each slot is matched with the admittance of this latter and that the coupling member of said excitation element of the waveguide has the effect of preventing as far as possible any additional mismatch other than that which is necessarily caused by the actual radiation of the slot.

Figure 1:
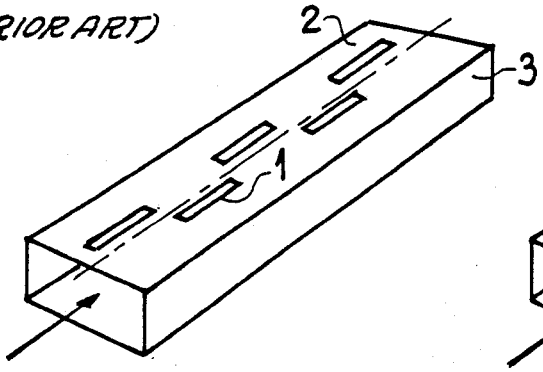
FIG 1 (a) (PRIOR ART)
Figure 1:
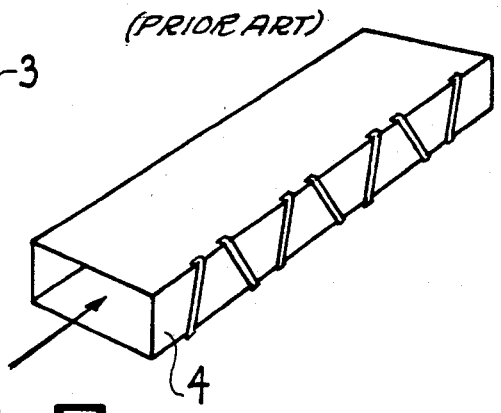
FIG 1 (b) (PRIOR ART)
Figure 2:
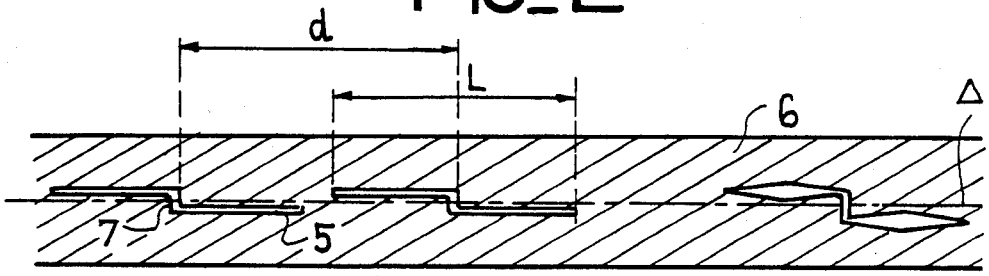

The three conditions are satisfied in the wide-band radiating-slot waveguide according to the invention as illustrated in the top view of FIG. 2.

Each slot 5 of the waveguide 6 is a full-wave slot of relatively substantial width, is widened if necessary in order to form a double lozenge, and is provided in its central portion with a transverse stepped section 7 formed at right angles to the longitudinal axis Δ of the slot. It is known that a full-wave dipole which is excited at its center—especially if its segments are of relatively substantial width—has a high input impedance and higher frequency stability than a half-wave dipole. It may therefore be stated in accordance with Babinet's principle mentioned earlier that a full-wave slot excited at its center has an admittance endowed with the same properties, namely a low input impedance having frequency stability. The slot can have a length L of slightly lower value than the operating wavelength (0.7 to 0.9λ) if the slot is broadened so as to form a double lozenge, for example, since in that case the second resonance is obtained in respect of a wavelength which is slighly shorter than λ. This phenomenon will be enhanced even further if the slot is covered by or filled with dielectric material for reasons of protection of leak-tightness. The distance d between the center of two successive slots 5 is in the vicinity of the operating wavelength λ of the waveguide.

Figure 3:
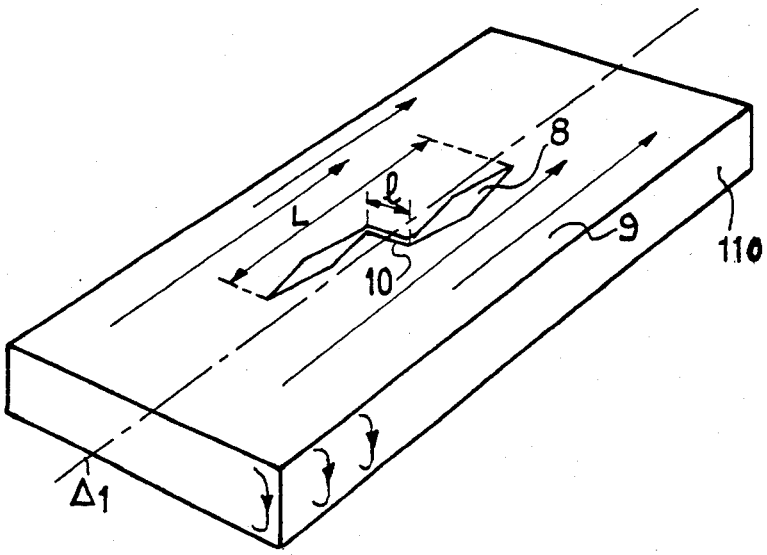
Figure 4:
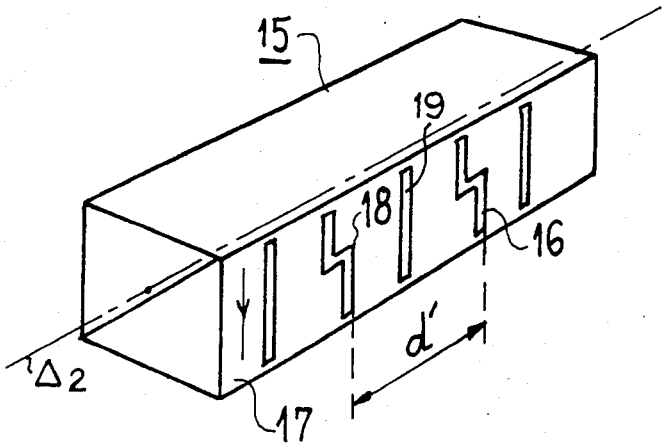

Two particular cases of construction are contemplated and illustrated in FIGS. 3 and 4. In FIG. 3 (in which only one slot is shown), slots 8 are formed on one broad side 9 of a waveguide 110. Said slots 8 are broadened so as to form a double lozenge and disposed lengthwise or in other words along the longitudinal axis $\Delta_1$ of the broad side 9. The positions of the slots are such that these latter are parallel to the current lines except at the level of their transverse stepped section 10 which intersects said lines. Each slot is not excited over its entire length L but solely at its center which is the precise point at which its radiation impedance is frequency-stable. The dimension 1 of the transverse stepped section 10 which is perpendicular to the longitudinal axis $\Delta_1$ of the broad side of the waveguide determines the coefficient of coupling of the slot. Thus the transverse stepped section 10 placed at the center of the slot serves as an element for excitation of the slot and for coupling to the supply waveguide.

The second particular case of construction illustrated in FIG. 4 concerns a waveguide 15 having slots 16 placed on one narrow side 17 of said guide in a transverse direction or in other words at right angles to the longitudinal axis $\Delta_2$ of the waveguide 15. The slots 16 are formed parallel to the lines of current which propagates on said narrow side 17 of the guide. A transverse stepped section 18 formed in each slot and located in the central portion of this latter accordingly intersects the current lines as explained earlier. In order to avoid an excessively high coupling coefficient arising from the fact that the slots 16 are placed in parallel relation, a conventional slot 19 is placed between each slot 16 and parallel to this latter. Said conventional slot is not excited since it does not intersect the current lines and thus performs the function of reflector.

The distance between two excited slots 16 is in the vicinity of the wavelength $\lambda$ and the transverse stepped section 18 of all the slots 16 is in the same direction in order to prevent radiation in crossed polarization with alternate phases which would be liable to impair the quality of the radiation of the slotted waveguide.

A slotted rectangular guide of this type also has fairly high directivity and permits direct radiation of a horizontally polarized wave, thereby dispensing with the need for a polarizer in order to transform a vertically polarized wave. A waveguide of the vertically polarized type as illustrated in FIG. 4 can accordingly be constructed. Said waveguide has a nearly square cross-section, the dimensions of the sides being slightly smaller than the operating wavelength.

Figure 5:
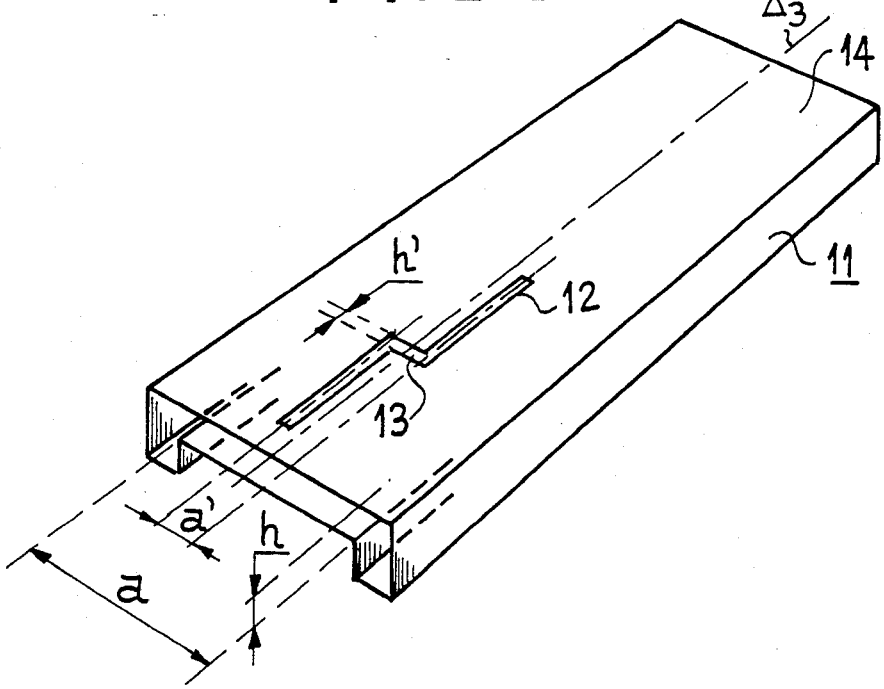

FIG. 5 illustrates an embodiment of a waveguide 11 of the same type as the guide described in FIG. 3 but of improved design as a result of the special shape of the so-called ridge waveguide which has been adopted. Only one slot is shown in this figure.

In fact, by virtue of its inherent design, a waveguide of this type is less dispersive than a conventional rectangular waveguide since it has the effect of setting-back the cutoff frequency of the fundamental mode. This has the advantage of lower frequency sensitivity of the direction of pointing of the beam of radiation emitted by the waveguide.

Furthermore, the slots 12 are weakly coupled to the waveguide since the currents which propagate in this type of guide are practically all longitudinal (the transverse currents appearing on the narrow sides of the guide are of very low value), with the result that the slots 12 cause no interference with said currents. Only the transverse stepped section 13 located at the center of each slot 12 cuts across or intersects these currents and therefore produces the coupling.

Furthermore, it can be demonstrated that the coupling coefficient of the slots 12 of the waveguide 11 is evaluated geometrically and is therefore little affected by the operating frequency of the radiating-slot waveguide. The following formula:

$$K = C\,(a'/a)\cdot(h'/h)$$

gives approximately the expression of the coefficient of coupling K of the slots to the waveguide as a function of the width a of the band of the broad side 14 in which the longitudinal currents are of high value, of the equivalent width a' of the slot, of the height h of the waveguide (the dimension between the two broad sides of the guide) and of the height h' of the transverse stepped section 13 (or the dimension defined in a direction parallel to the longitudinal axis $\Delta_3$ of the broad side 14 of the guide), where C is a numerical coefficient of proportionality.

The direct-radiation slotted rectangular waveguide thus described has the advantage of operating over a wide frequency band.

What is claimed is:

1. A rectangular waveguide having pairs of narrow and wide sides and defining a longitudinal axis, said waveguide comprising direct-radiation slots, each slot being disposed on one of the narrow sides of the waveguide in parallel relation to each other and orthogonal to the longitudinal axis of the waveguide so as to be parallel to the lines of current flow along said one narrow side, each said slot having a lenght L in the vicinity of the operating wavelength $\lambda$ of said waveguide and including a transverse stepped section formed in the central portion of the slot orthogonal to the current lines, and wherein a distance d is defined between the transverse stepped sections of successive slots so as to be in the vicinity of the wavelength $\lambda$ of said waveguide.

2. A waveguide according to claim 1, wherein the slots are widened so as to form of double lozenge.

3. A waveguide according to claim 1, wherein the transverse stepped section of all the slots is located in the same direction.

4. A waveguide according to claim 3, wherein two consecutive slots each having a transverse stepped section are separated by a conventional slot which is parallel to the lines of current flows across the narrow side of the guide and which performs the function of reflector.

5. A waveguide according to claim 1, wherein said waveguide is of the ridge type.

6. A rectangular waveguide having pairs of narrow and wide sides and defining a longitudinal axis, said waveguide comprising direct-radiation slots, each slot being disposed on one of the narrow sides of the waveguide in parallel relation to each other and orthogonal to the longitudinal axis of the waveguide so as to be parallel to the lines of current flow along said one narrow side, each said slot having a length L in the vicinity of the operating wavelength $\lambda$ of said waveguide and including a transverse stepped section formed in the central portion of said slot orthogonal to the current lines, and wherein two consecutive slots each having a transverse stepped section are separated by a conventional slot which is parallel to the lines of current flow across the narrow side of the waveguide and which functions as a reflector.

* * * * *